US007828498B2

(12) United States Patent
Sorheim et al.

(10) Patent No.: US 7,828,498 B2
(45) Date of Patent: Nov. 9, 2010

(54) CONNECTION MECHANISM FOR LARGE SCALE RETAINING WALL BLOCKS

(76) Inventors: Daniel R. Sorheim, 3803 NE. 86th St., Medford, MN (US) 55049; Dan J. Hotek, 300 Sky Meadow La., Front Royal, VA (US) 34205

( * ) Notice: Subject to any disclaimer, the term of this patent is extended or adjusted under 35 U.S.C. 154(b) by 27 days.

(21) Appl. No.: 12/416,965

(22) Filed: Apr. 2, 2009

(65) Prior Publication Data

US 2009/0252561 A1 Oct. 8, 2009

Related U.S. Application Data

(60) Provisional application No. 61/041,757, filed on Apr. 2, 2008.

(51) Int. Cl.
*E02D 29/02* (2006.01)

(52) U.S. Cl. ..... 405/287; 405/262; 405/286

(58) Field of Classification Search ..... 405/262, 405/284, 286, 287
See application file for complete search history.

(56) References Cited

U.S. PATENT DOCUMENTS 4,929,125 A * 5/1990 Hilfiker ..... 405/262
4,936,713 A 6/1990 Miner
4,964,761 A 10/1990 Rossi
5,294,216 A 3/1994 Sievert
5,350,256 A 9/1994 Hammer
5,505,034 A 4/1996 Dueck
5,511,910 A 4/1996 Scales
5,651,641 A 7/1997 Stephens et al.
5,702,208 A 12/1997 Hilfiker et al.
5,820,304 A 10/1998 Sorheim et al.
5,839,855 A * 11/1998 Anderson et al. ..... 405/262
5,934,838 A 8/1999 Egan
6,186,703 B1 * 2/2001 Shaw ..... 405/262
6,447,211 B1 9/2002 Scales et al.
6,447,212 B2 * 9/2002 Orsat ..... 405/262
6,679,656 B1 1/2004 Manthei
6,793,436 B1 * 9/2004 Ruel et al. ..... 405/284
6,796,098 B2 9/2004 Hampton
6,860,681 B2 * 3/2005 Ruel ..... 405/286
6,862,856 B2 3/2005 Turgeon-Schramm et al.
6,939,087 B2 * 9/2005 Ruel ..... 405/286
7,073,304 B2 7/2006 Hampton
7,114,887 B1 10/2006 Rainey (Continued)

*Primary Examiner*—Frederick L Lagman
(74) *Attorney, Agent, or Firm*—Larkin Hoffman Daly & Lindgren Ltd.; Craig J. Lervick

(57) ABSTRACT

A block assembly includes integral connection mechanisms specifically designed for incorporation into engineered retaining walls. These connection mechanisms specifically accommodate the use of reinforcing grids in the formation of a retaining wall which, when used, will stabilize the retaining wall and provide additional strength. The connection mechanism is formed prior to fabrication of the block itself, and thus can be integrally incorporated during casting/fabrication of the block itself. The connection mechanism defines a connection slot usable during retaining wall fabrication (by allowing easy connection to the reinforcing grid) while also accommodating holding and lifting of the block assembly. Due to the fabrication method, the configuration of the connection mechanisms inserted into the block can be uniquely designed to provide desired physical coupling once the concrete is hardened. This further allows the use of different materials and different structures to provide the desired strength and allow the use of optimal materials.

17 Claims, 13 Drawing Sheets

U.S. PATENT DOCUMENTS 7,390,146 B2 6/2008 Rainey
7,445,407 B2 11/2008 Rainey
7,491,018 B2 * 2/2009 Freitag et al. ..... 405/286
7,722,296 B1 * 5/2010 Taylor ..... 405/286
2002/0124516 A1 9/2002 Paulson
2005/0042040 A1 2/2005 Paulson
2008/0085162 A1 4/2008 Blundell

* cited by examiner

CONNECTION MECHANISM FOR LARGE SCALE RETAINING WALL BLOCKS

BACKGROUND OF THE INVENTION

The present invention relates to stackable block members and a method of using the block members to build retaining walls. More particularly, the present invention relates to stackable, pre-cast block members having an improved connection mechanism allowing retaining walls to be anchored in place so as to minimize movement of the block members after construction.

Retaining walls have long been used to prevent berms, slopes and embankments from sliding and slumping. Additionally, retaining walls are used as one mechanism to control soil erosion. These structures are often used to support naturally occurring slopes and embankments while also accommodating the construction of artificial slopes, embankments, planters, stairways, stream banks and similar earthworks. In these applications Pre-cast concrete blocks are a particularly useful and versatile material for constructing retaining walls.

A number of complex, and expensive, retaining wall systems have been developed for building relatively tall retaining walls (i.e. those over about 12 feet in height). The construction of such tall retaining walls typically involves (or requires) soil studies and professional engineering support. In typical conditions, retaining walls up to approximately 40 inches in height may be constructed from concrete blocks of reasonable size and the concrete blocks alone are sufficient to prevent sliding and slumping. These relatively short walls are often designed and built by contractors and home owners and do not require either soil studies or professional engineering support.

Many applications exist which require retaining walls taller than 40 inches in height, including commercial/industrial applications. Generally speaking, concrete blocks of reasonable size alone are not sufficient for these retaining walls and some method of holding the concrete blocks in position is required.

As one example of an engineered solution, a three-block system which uses wall blocks mechanically connected to and anchored by a trunk block and a tail block is shown in U.S. Pat. No. 5,350,256 to Hammer. In that system, each of the wall blocks in each course of wall blocks is connected to a trunk block which is in turn mechanically connected to a tail block. The combination of the trunk block and the tail block serves to anchor the wall block. The relative sizes of the blocks used in that system are such that the weights of the trunk block and the tail block are each nearly as great as the weight of the wall block. Unfortunately the number of trunk and tail blocks required, and the labor necessary to lay those additional blocks drives up the cost of constructing such a retaining wall.

U.S. Pat. No. 5,820,304 to Sorheim et al. describes an alternate system to achieve anchoring of the wall. More specifically, a network of uniform anchor blocks can be attached to facing blocks to provide the necessary anchoring behind the wall.

Additional systems of wall blocks which rely upon a mechanical connection between wall blocks in adjacent courses are shown in U.S. Pat. No. 5,294,216 to Sievert, and U.S. Pat. No. 5,505,034 to Dueck. Such systems rely upon the weight of the wall blocks and are not sufficient for building retaining walls of even an intermediate height.

A method of anchoring wall blocks with a lattice-like grid (i.e., "geogrid") connected to the wall blocks is shown in U.S. Pat. No. 5,511,910 to Scales. Such grids are positioned between stacked wall blocks and extend rearwardly away from the blocks. The grids are then buried within fill material behind the retaining walls to anchor the blocks in place. While attachment of the geogrid is conveniently achieved, this structure becomes difficult to use with larger blocks (e.g. 24"×36" blocks).

Another alternative to the design disclosed in the '910 patent to Scales is illustrated in FIG. 1. As shown in FIG. 1, each wall block includes a channel on a top surface thereof that is structured to receive an elongate bar member. A grid structure is wrapped around the elongate bar member prior to positioning the bar member within the channel. The grid structure is then routed toward the rear of the block, and a second block is stacked on top of the first block. As a result, the grid structure is "sandwiched" between the first and second blocks.

One problem with designs such as those disclosed in the '910 patent to Scales and illustrated in FIG. 1 is the interference of the grid structure with successively stacked blocks. In particular, the grid structure introduces an additional thickness between the top surface of a first block and the bottom surface of a second block stacked on top of the first block. For example, the thickness of the grid structure may be about 0.125 inches. However, as more and more blocks are stacked on top of one another, the combined thickness of each grid structure adds up quickly and causes the retaining wall to "lean forward" (i.e., become "non-vertical") and lose stability.

Generally, most prior retaining wall block assemblies utilized friction between wall face units to generate a "connection." Differential settlement or other problems would often diminish or eliminate this connection. Other types of connections included, for example, a bar "botkin connection." However, this type of connection had a lesser capacity than the grid structure itself, making the connection the weak link.

Therefore, a need exists for a retaining wall system which: (a) utilizes pre-cast wall blocks of large size and weight; (b) provides a cost effective method of anchoring the wall blocks; (c) eliminates the positioning of a grid structure between the top surface of one wall block and the bottom surface of another wall block; and (d) can be built to significant heights while minimizing the risk of tipping or becoming otherwise unstable.

SUMMARY OF THE INVENTION

To address the above-discussed needs, a retaining wall block is provided which includes integrated attachment mechanisms easily accommodating geogrid type stabilizing structures. Further, the attachment mechanism allows for more convenient handling of the blocks themselves. Further, the retaining wall block is easily constructed to include this connection mechanism in a manner that is efficient and effective.

The retaining wall blocks in the present invention are pre-cast blocks fabricated utilizing predesigned molds. As common in the fabrication of pre-cast blocks, a concrete or a cement mixture is poured into the mold and allowed to appropriately cure. As is typical, the mold includes an open top end, thus exposing a portion of the concrete. As anticipated, the block itself is designed to cause this exposed surface to be the back or rear portion of the block. In one embodiment of the present invention, this exposed surface is utilized to accommodate the incorporation of an integral attachment mechanism within the fabricated block itself. In this case, an attachment structure is prefabricated and on hand during the block forming process. Once concrete has been poured into the mold, this attachment structure is then inserted into the wet concrete at the open end of the mold itself. Subsequently, the concrete is allowed to harden thus causing the holding structure to be an intracal portion of the block itself.

Utilizing a similar process, blocks of different types can be easily formed. Further, wall-panels or other structures can also be easily fabricated.

The retaining wall block or panel assemblies fabricated as outlined above have many benefits: The retaining wall block assemblies may be made of materials already utilized or produced by the pre-cast concrete industry, thus reducing out of pocket costs. Further, the retaining wall block assemblies are constructed with reduced complexity, thus helping to control costs and increase productivity.

As an alternative, the block assembly could be formed in one mold. This approach somewhat complicates the mold to be used, but would achieve a similar result. The mold involved would require structures to form the attachment mechanism, and would need to accommodate removal. This option would require the block to be formed side down, as opposed to face down. Alternatively, such a block assembly could be formed face up, with the face surface finished in some other process.

Creating the retaining wall block assemblies as discussed above allows the use of multiple components and materials. Additionally, the connection mechanism can be formed prior to forming the retaining wall block. Also, the connection mechanism can be used as a lifting device, thus eliminating the need for such a structure on top of the retaining wall block.

In the present block assembly, a concrete of differing strength can be used in the connection mechanism, thus optimizing the use of higher cost materials (e.g. locating them at the point of highest load concentration).

The retaining wall block assemblies solve the engineering problem of attaching a grid structure to a concrete panel using the integrated connection mechanism. This approach provides a cheaper and structurally superior method.

The two part construction of the connection mechanism takes advantage of the high compression strength of concrete and the high tensile strength of steel.

The connection mechanism of the present invention may include reinforcing components encased in high density concrete as opposed to a coating that may be damaged or corrode over time, adding to the structural superiority of the connection mechanism. Further, the connection mechanism may include curved edges to protect the grid structure from being damaged.

When used to create a wall structure, the retaining wall blocks are allowed to settle without generating additional shears on the grid structure due to the wrap-around configuration of the grid structure. This enables the grid structure to rotate and not just shear. In a similar manner, the connection mechanism accommodates the use of more economical strips of high strength grid structure. These strips are more easily handled than large mats and are a more efficient use of material.

DETAILED DESCRIPTION OF THE INVENTION

Figure 1:
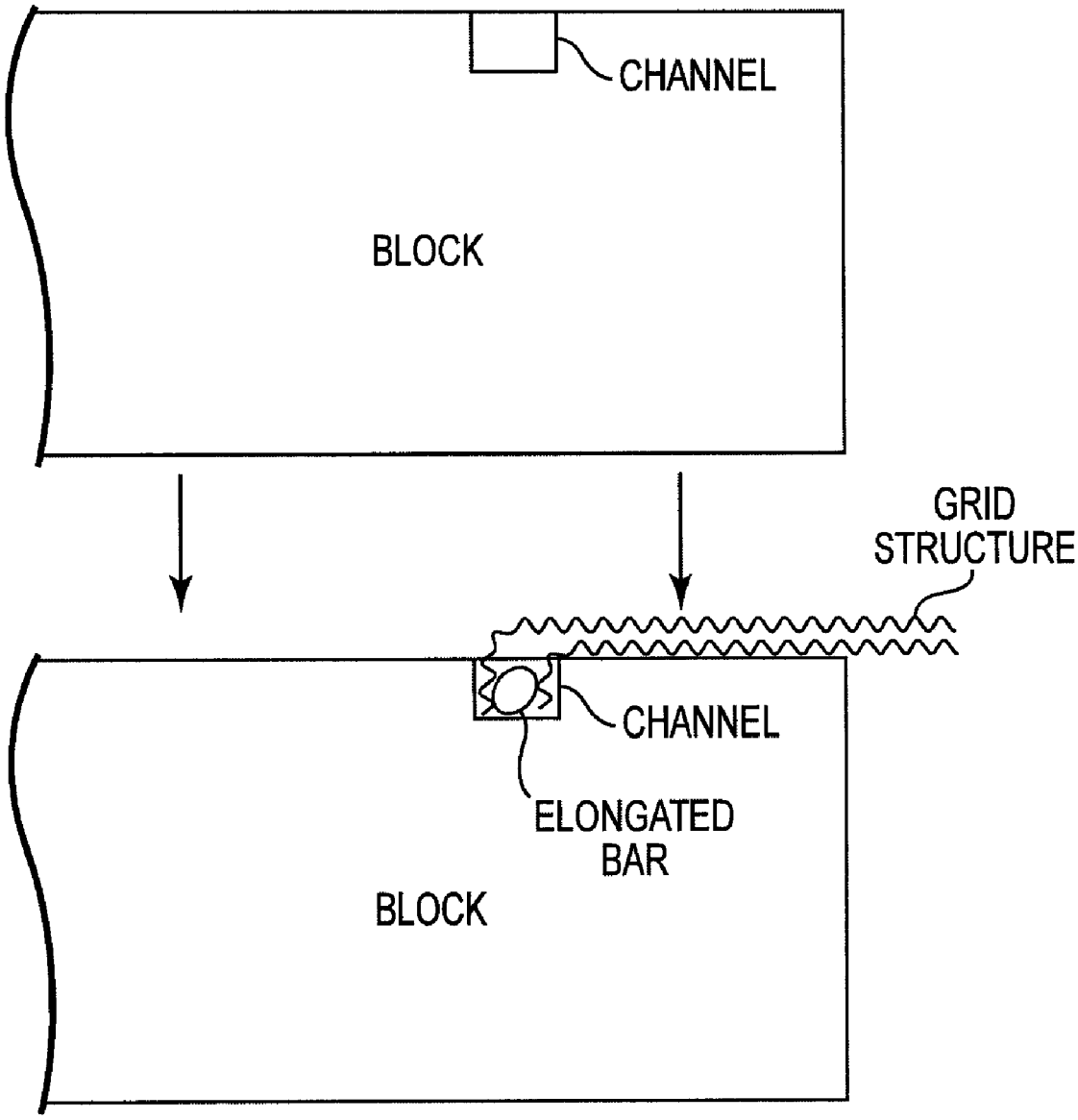
Fig. 1 (PRIOR ART)
FIG. 1 is a diagram illustrating one embodiment of a prior art retaining wall block anchoring system.
Figure 2:
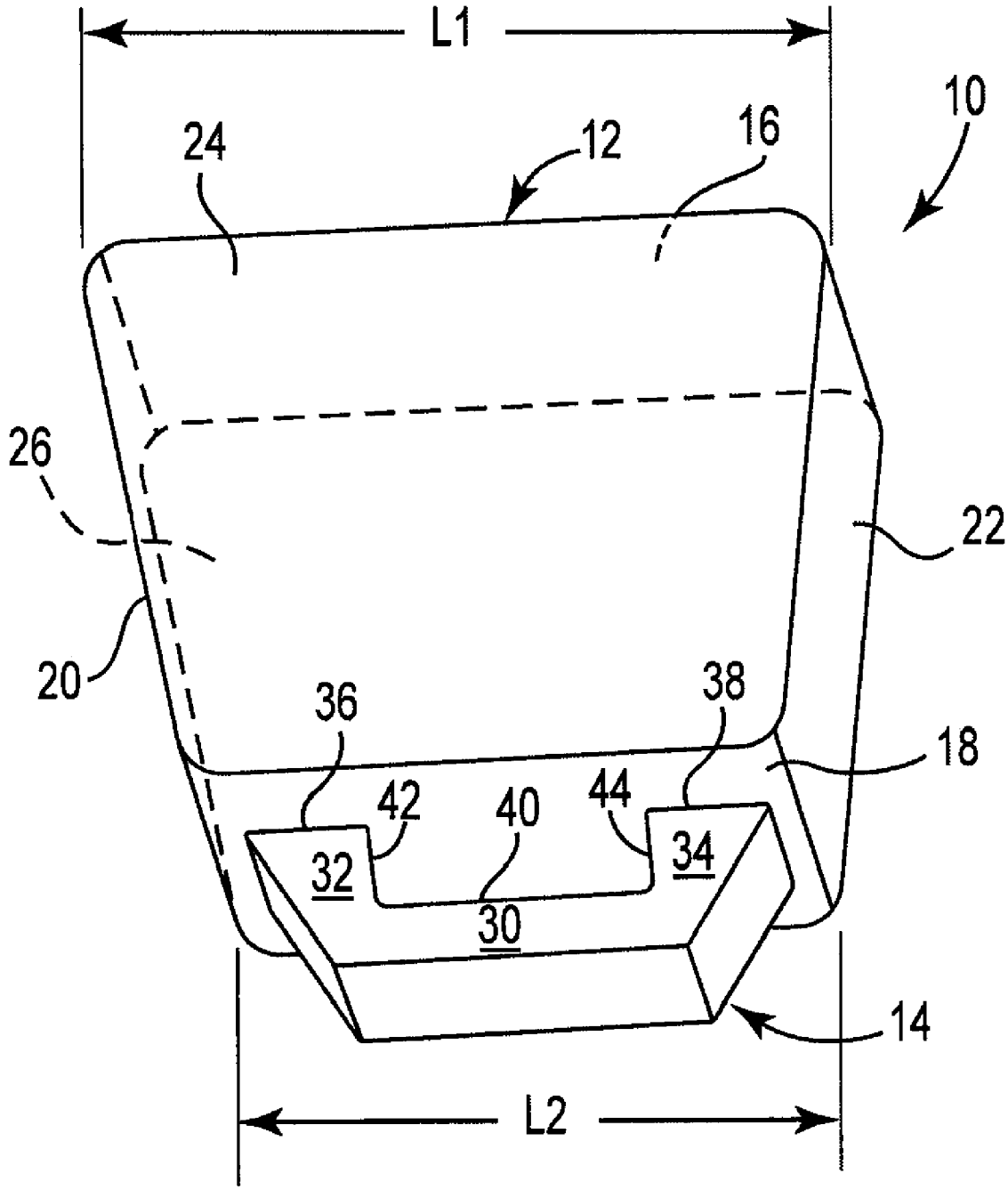
FIG. 2 is a top perspective view of one exemplary embodiment of a retaining wall block assembly in accordance with the present invention, which includes a retaining wall block and a connection mechanism.

Referring now to FIG. 2 a top perspective view of one exemplary embodiment of a retaining wall block assembly 10 is illustrated. Retaining wall block assembly 10 generally includes retaining wall block 12 and connection mechanism 14 attached thereto.

Retaining wall bock 12 may be formed using numerous methods and from numerous materials as will be appreciated by those skilled in the art. However, for purposes of example and not limitation, the present discussion will focus on a retaining wall block 12 formed by pouring concrete into a casting shell.

As shown in FIG. 2, retaining wall block 12 includes front surface 16, rear surface 18, first side 20, second side 22, top surface 24, and bottom surface 26. In this particular embodiment, retaining wall block 12 is shaped with unequal face lengths, wherein the length L1 of front surface 16 is greater than the length L2 of rear surface 18, and wherein first and second sides 20 and 22 form an obtuse angle with rear surface 18. Those skilled in the art will appreciate that retaining wall blocks having various shapes, sizes, surface lengths, and/or a numbers of "sides" are contemplated and within the intended scope of the present invention.

As shown in FIG. 2, connection mechanism 14 is coupled to and extends from a rear portion of retaining wall block 12. Connection mechanism 14 generally includes main body 30, first arm 32, and second arm 34. When assembled as shown in FIG. 2, end portions 36 and 38 of first and second arms 32 and 34, respectively, are integral with a rear portion of retaining wall block 12. These components form a connection slot 39 formed between main body 30 and rear portion of retaining wall block 12. Furthermore, inner surface 40 of connection main body 30 includes curved or rounded edges to help prevent a coupled grid structure from tearing or otherwise becoming damaged (discussed in further detail to follow). In addition, inner surfaces 42 and 44 of first and second arms 32 and 34, respectively, may also include curved edges similar to inner surface 40 of main body 30.

Figure 3:
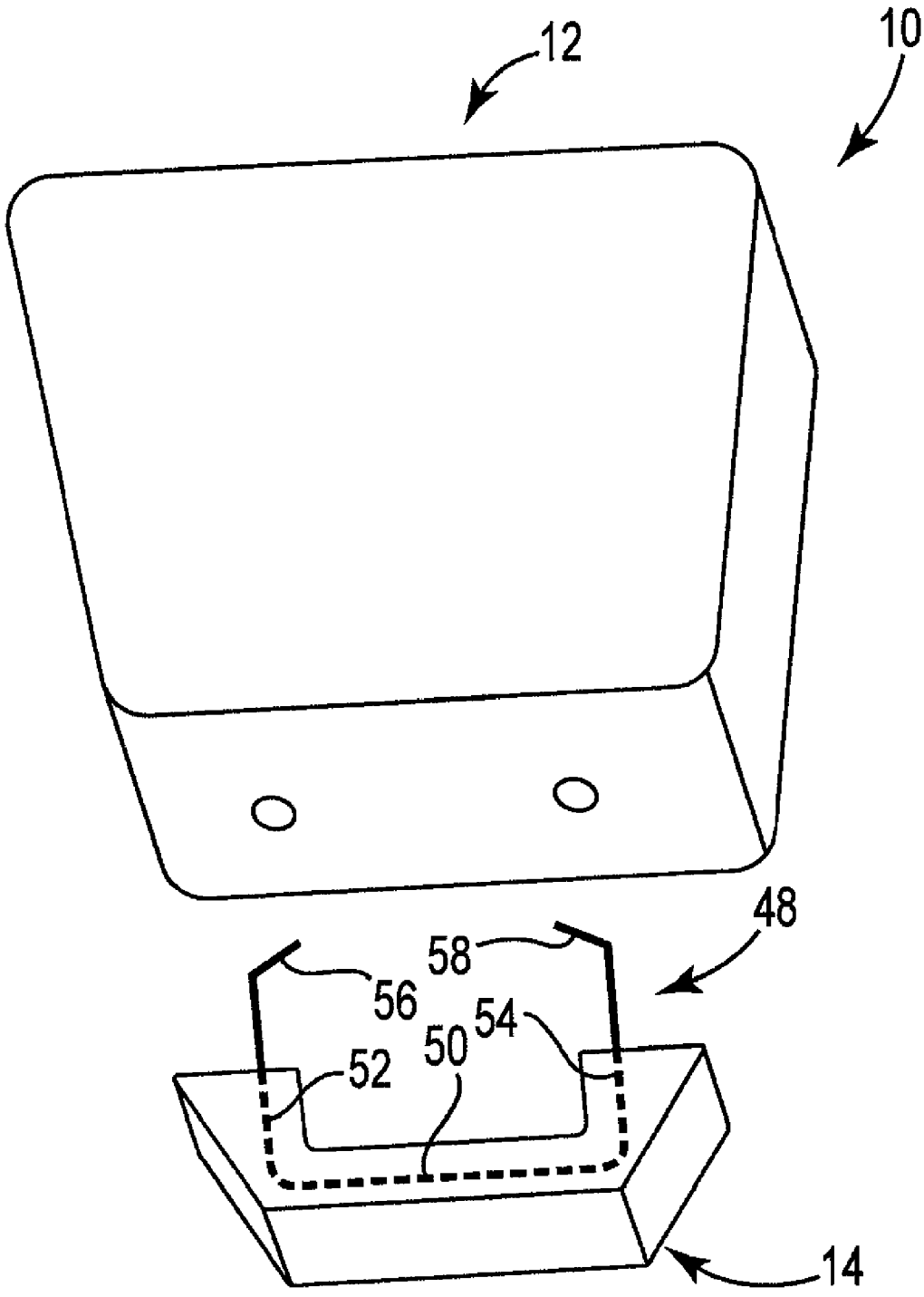
FIG. 3 is an exploded perspective view of the retaining wall block assembly of FIG. 1.

FIG. 3 is an exploded perspective view of the retaining wall block assembly 10 of FIG. 2. As shown in FIG. 3, connection mechanism 14 further includes an internal strengthening member 48 having main body portion 50, first arm 52, and second arm 54. First arm 52 includes first flange member 56 extending therefrom, while second arm 54 includes a similar flange member 58. In one embodiment, internal strengthening member 48 is preconfigured reinforcing bar material which is typically available to most concrete companies. Other materials contemplated may include other steel or metal materials, coated metals, carbon fiber, fiberglass, fiberglass reinforced plastic, or other composite materials depending on the particular application.

As stated above, retaining wall block 12 may be formed from a concrete material, such as wet cast or low slump concrete. Connection mechanism 14 may also be formed from materials similar to those used to form retaining wall block 12, although using such similar materials is not necessary. In one exemplary method of constructing retaining wall block assembly 10, connection mechanism 14 may be formed prior to forming retaining wall block 12, such as one or more days in advance of retaining wall block 12. This allows first and second flange members 56 and 58 (along with a portion of first and second arms 52 and 54) of connection mechanism 14 to be positioned within the un-solidified concrete being used to form retaining wall block 12. Thus, when the concrete of retaining wall block 12 solidifies, connection mechanism 14 will be securely coupled to retaining wall block 12 due to the hardening of concrete around first and second flange members 56 and 58. Further, a portion of first and second arms 32 and 34 may also be submerged in the unsolidified concrete. The angle portions of flange members 56 and 58 function similar to "hooks" and are structured to prevent first and second arms 52 and 54, respectively, from being pulled from within retaining wall block 12 when an opposing force is applied to connection mechanism 14.

As an alternative, the connection mechanism 14 and block 12 could be formed in a single mold. Naturally, this approach requires a more complex mold, and must specifically accommodate the connection mechanism (e.g. form this structure while also allowing the mold to be removed). Also, an appropriate holding structure would be necessary to position internal strengthening member. While the mold will be more complicated, a single molding step can be used.

As those skilled in the art will appreciate, internal strengthening member 48 may be formed from any suitable material that has a high tensile strength. For example, internal strengthening member 48 may be formed from a steel bar as is typical for many concrete products. However, numerous other materials such as various other metals, fiberglass, fiberglass reinforced plastics, carbon fiber and the like, are also contemplated.

Connection mechanism 14 is able to provide improved structural superiority due to its "two part" construction. In particular, the two part construction of connection mechanism 14 of the above described embodiment takes advantage of the high compression strength of concrete as well as the high tensile strength of steel. More specifically, this design provides an advantage over other products which simply include various elements embedded into the concrete, as such elements typically act alone in shear and/or bending. Conversely, the two part construction of the present invention allows the two materials to work in conjunction with one another.

In alternative embodiments, retaining wall block 12 and connection mechanism 14 may be made from different materials, such as different types of concrete. This allows, for example, a stronger concrete to be used at the point of highest load concentration (i.e. in the connection mechanism 14) and a slightly weaker concrete to be used in retaining wall block 12 where the load concentration is not as high. As a result, retaining wall block assemblies may be constructed so as to maximize strength in the critical areas as well as to minimize overall cost.

As those skilled in the art will appreciate, moving a large and heavy retaining wall block during construction of a retaining wall can be very awkward and difficult. Connection mechanism 14 helps to alleviate these problems by also serving as a handle or lifting device for moving retaining wall block 12.

Figure 4:
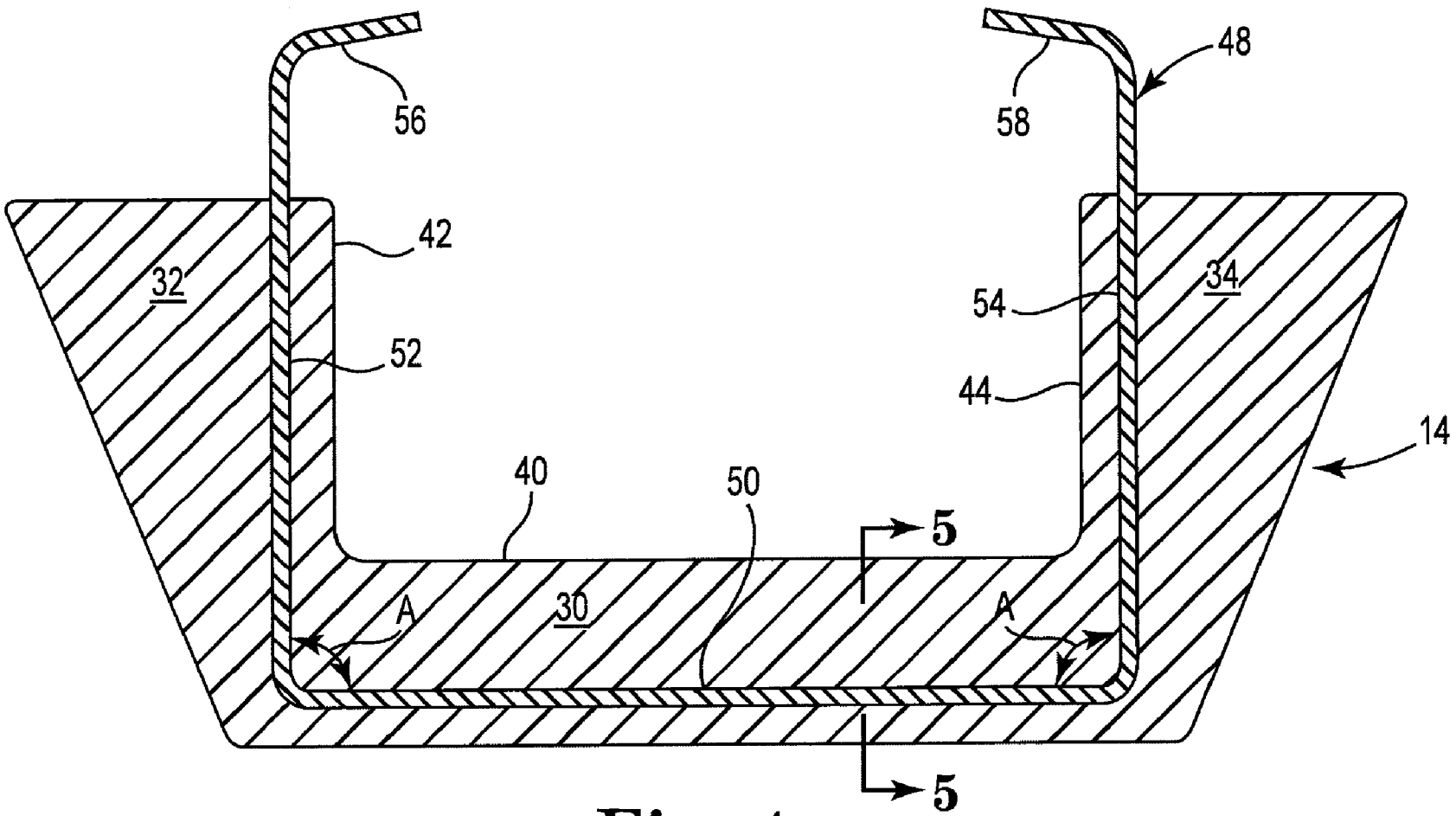
FIG. 4 is a cross-sectional view of the connection mechanism illustrating the position of a block connector disposed therein.

FIG. 4 is a cross-sectional view of connection mechanism 14 illustrating the position of internal strengthening member 48 within main body 30, first arm 32, and second arm 34. As shown in FIG. 4, main body portion 50, first arm 52, and second arm 54 form a generally "U" shaped member mirroring the structure of connection mechanism 14. Thus, first and second arms 52 and 54 each form an angle A with main body portion 50 of internal block connector 48 that is about 90 degrees. However, in alternative embodiments, the shape of internal block connector 48 as well as its position within connection mechanism 14 may be modified without departing from the intended scope of the present invention. For example, first and second arms 52 and 54 of internal block connector 48 may alternatively form an angle with main body portion 50 that is greater or less than about 90 degrees.

Figure 5:
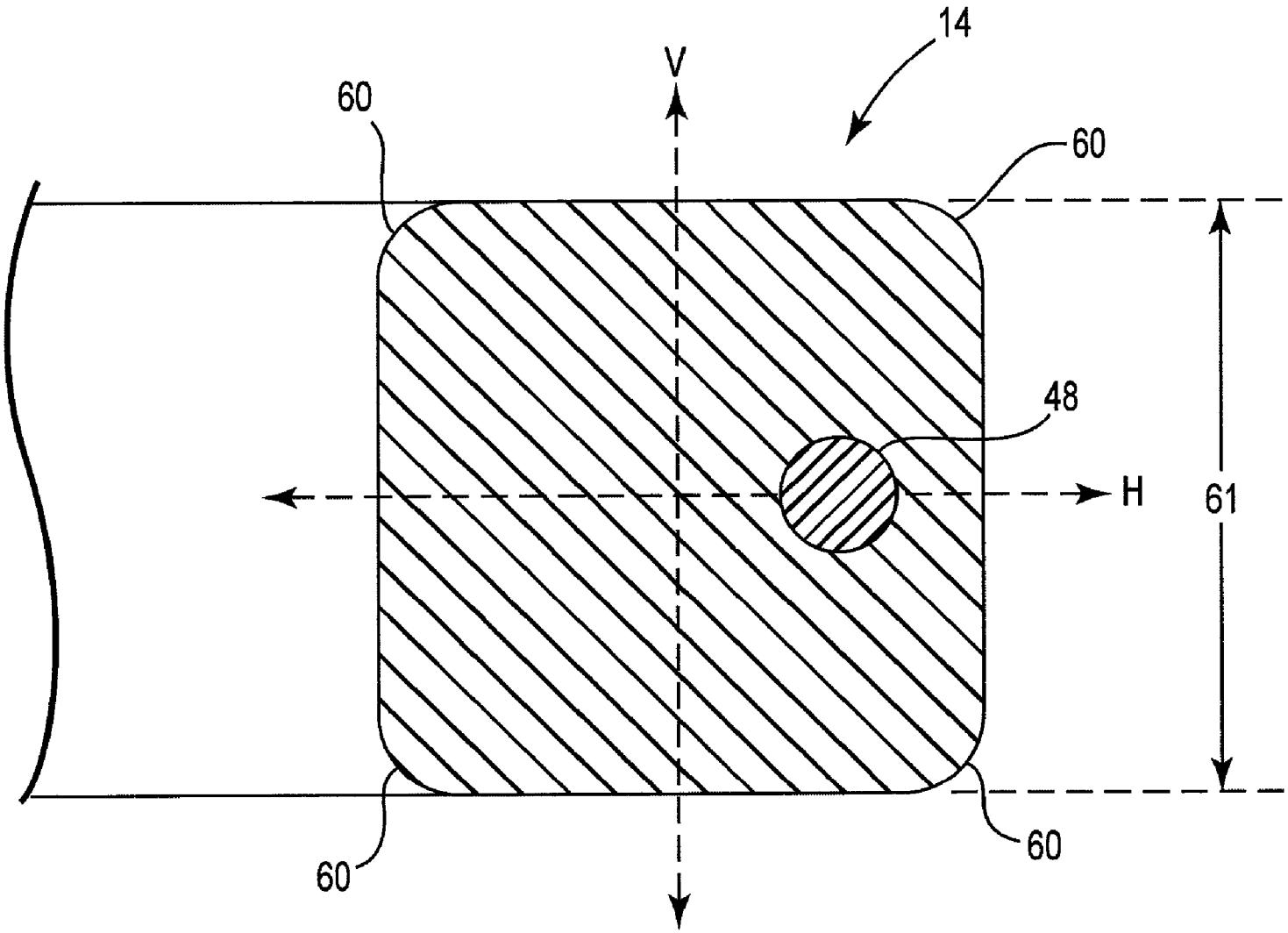
FIG. 5 is a cross-sectional view of the connection mechanism of FIG. 4.

FIG. 5 is a cross-sectional view of connection mechanism 14 shown and described above in reference to FIGS. 2-4. More specifically, this cross-section is shown along section lines 5-5 shown in FIG. 4. As illustrated, internal strengthening member 48 is approximately centered within connection mechanism 14 in the vertical direction V, while being off-centered in the horizontal direction H. This positioning provides strength advantages when subject to horizontal pulling forces. However, in other embodiments, internal strengthening member 48 may be approximately centered within connection mechanism 14 or off-centered by other amounts and/or directions without departing from the intended scope of the present invention.

As shown in FIG. 5, connection mechanism 14 has rounded edges 60 on each of the four corners. The presence of rounded edges 60 helps to protect a grid structure positioned adjacent connection mechanism 14 from the rough or squared off edges of the connection mechanism that would otherwise be present, thereby minimizing the possibility of cutting or otherwise damaging the grid structure.

Connection mechanism 14 has a vertical height 61 that may be selected based upon the size of the retaining wall block with which it will be used. However, in one exemplary embodiment, vertical height 61 may be about 6 inches.

Although internal strengthening member 48 is shown as having a generally circular cross-section, those skilled in the art will appreciate that numerous other cross-sectional shapes are also contemplated. For example, alternative embodiments of internal strengthening member 48 may have a generally oval, square, or rectangular cross-sectional shape. In other embodiments, the cross-sectional shape and/or dimensions of the block connector may vary at different points along the block connector. For instance, in one embodiment, first and second arms 52 and 54 may have a generally circular cross-sectional shape with a first diameter, while main body portion 50 may have a generally circular cross-sectional shape with a second diameter that is different than the first diameter. In another embodiment, first and second arms 52 and 54 may have a generally circular cross-sectional shape, while main body portion 50 may have a generally square cross-sectional shape. The actual configuration may also be somewhat dependent upon the particular materials utilized and the manufacturing methods utilized to create internal strengthening member 48.

Figure 6:
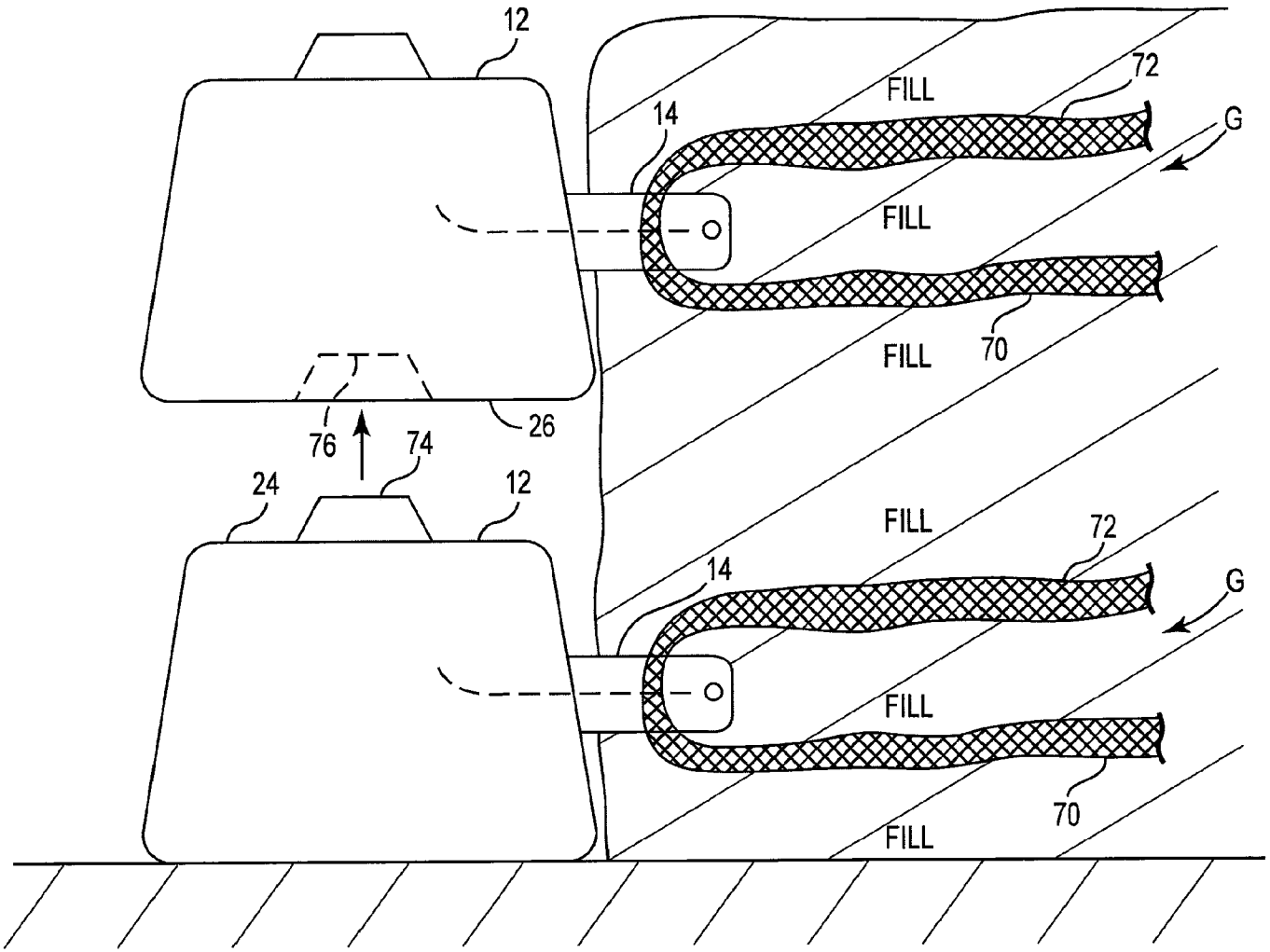
FIG. 6 is a side view illustrating a pair of retaining wall block assemblies incorporating a stabilizing grid structure.

FIG. 6 is a side view of a pair of retaining wall block assemblies 10 in accordance with the present invention illustrating the positioning of a grid structure G and the stackability of blocks 10. In particular, a grid structure G may be wrapped around inner surface 40 (not shown) of connection mechanism 14. Because connection mechanism 14 is designed with rounded edges 60 (as shown in FIG. 5), grid structure G contacts only smooth, formed concrete. As a result, the wear on grid structure G is minimized, thereby greatly reducing the possibility that grid structure G may fail (such as by breaking or otherwise becoming damaged) after the retaining wall is constructed.

During construction of a retaining wall, a first retaining wall block assembly 10 is set in place, and a fill material such as dirt or gravel is inserted behind retaining wall block 12. Next, a first layer 70 of grid structure G is positioned on top of the fill material and wrapped around connection mechanism 14. Another layer of fill material is then inserted between first layer 70 and second layer 72. Yet another layer of fill material is then inserted on top of second layer 72, and the process continues with additional block assemblies until the desired wall height has been reached.

As shown in FIG. 6, top surface 24 of retaining wall block 12 may also include a protrusion 74 structured to cooperate with a recess 76 in bottom surface 26 of a retaining wall block 12. The combination of protrusion 74 and recess 76 serves as a "locking system" and may help to prevent movement of stacked retaining wall blocks 12 relative to one another after construction of the retaining wall.

Figure 7:
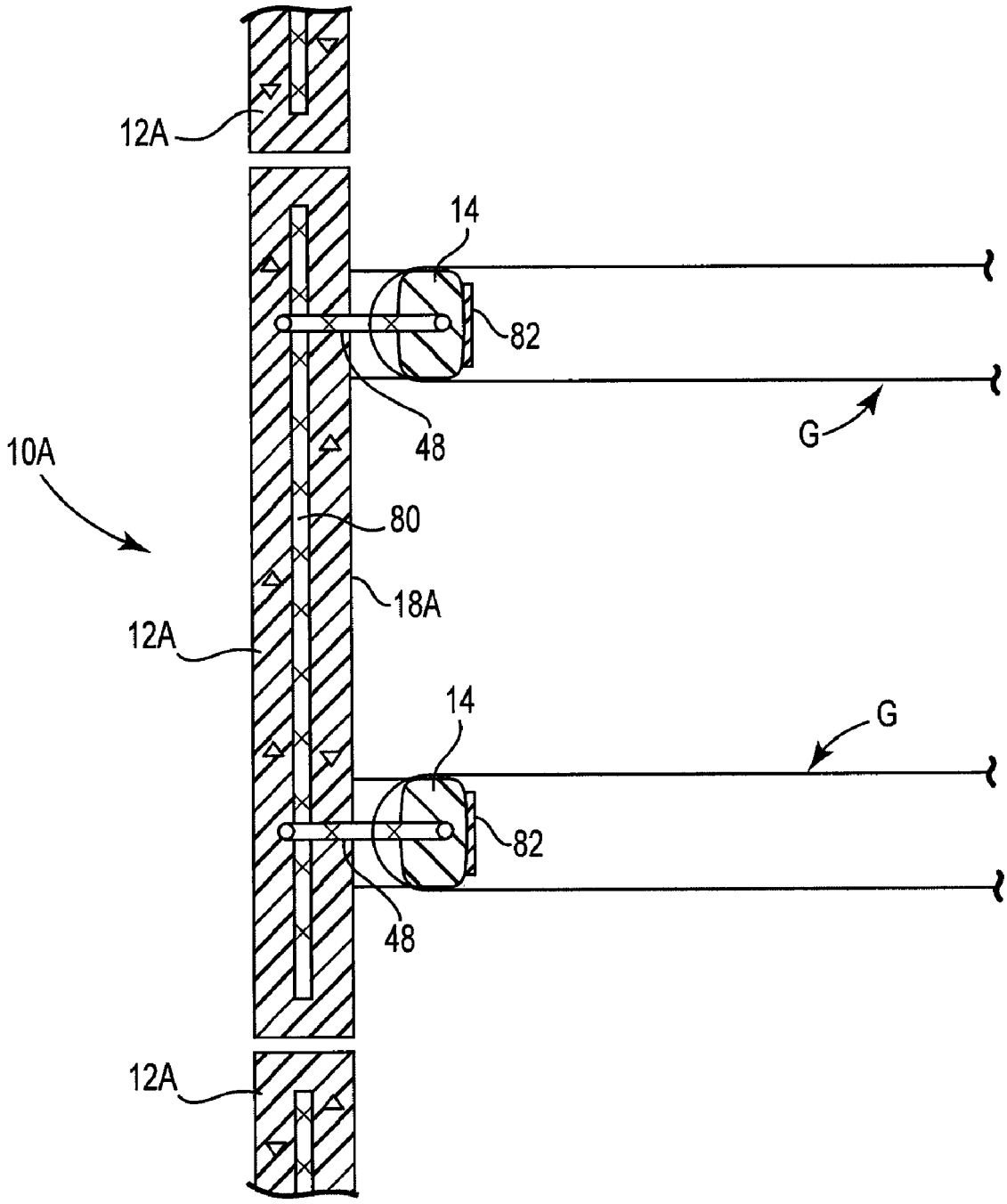
FIG. 7 illustrates an alternative embodiment, which includes a wall panel and a related connection mechanism.

FIG. 7 is a cross-sectional view of a wall assembly 10A, which is one alternative embodiment in accordance with the present invention. In particular, wall assembly 10A is similar to retaining wall block assembly 10 described above, with retaining wall block 12 being replaced by a taller, thinner concrete wall panel 12A. As illustrated, wall panel 12A includes a pair of connection mechanisms 14 similar to the connection mechanism previously described coupled to and extend from rear surface 18A. Once again, each connection mechanism 14 includes internal strengthening member 48, which may be formed from preconfigured reinforcing bar material typically available to concrete companies. Furthermore, internal strengthening member 48 includes a pair of arms with a corresponding pair of flange members extending into wall panel 12A, which are structured to prevent the arms from being pulled from within wall panel 12A when an opposing force is applied to connection mechanism 14.

Optionally, each flange member may be structured to engage a vertical reinforcing member 80 positioned within wall panel 12A. Vertical reinforcing member 80 may also be formed from a preconfigured reinforcing bar material similar to that used to form internal strengthening member 48. As outlined above in relation to the blocks 12, connection mechanisms could be formed prior to the fabrication of wall panels 12A, thus allowing for easy "attachment" during the fabrication process.

In addition, a cap member 82 structured to act as a transport dunnage may be coupled to a back side of each connection mechanism 14. Cap member 82 may be formed from any suitable material, including plastics and the like.

As illustrated in FIG. 7, a separate grid structure G may be wrapped around each connection mechanism 14 in a manner similar to that previously described in order to construct a wall by stacking a plurality of wall panels 12A on top of one another and burying the grid structures G in a fill material. While FIG. 7 illustrates a pair of connection mechanisms 14 evenly distributed across wall panel 12A, alternative configurations are possible. For example, in applications where only a portion of wall panel 12A will be backfilled, only a single connection mechanism 14 will be necessary. In this alternative example, additional wall members would obviously not be stacked on top of the existing wall member 12A.

Figure 8:
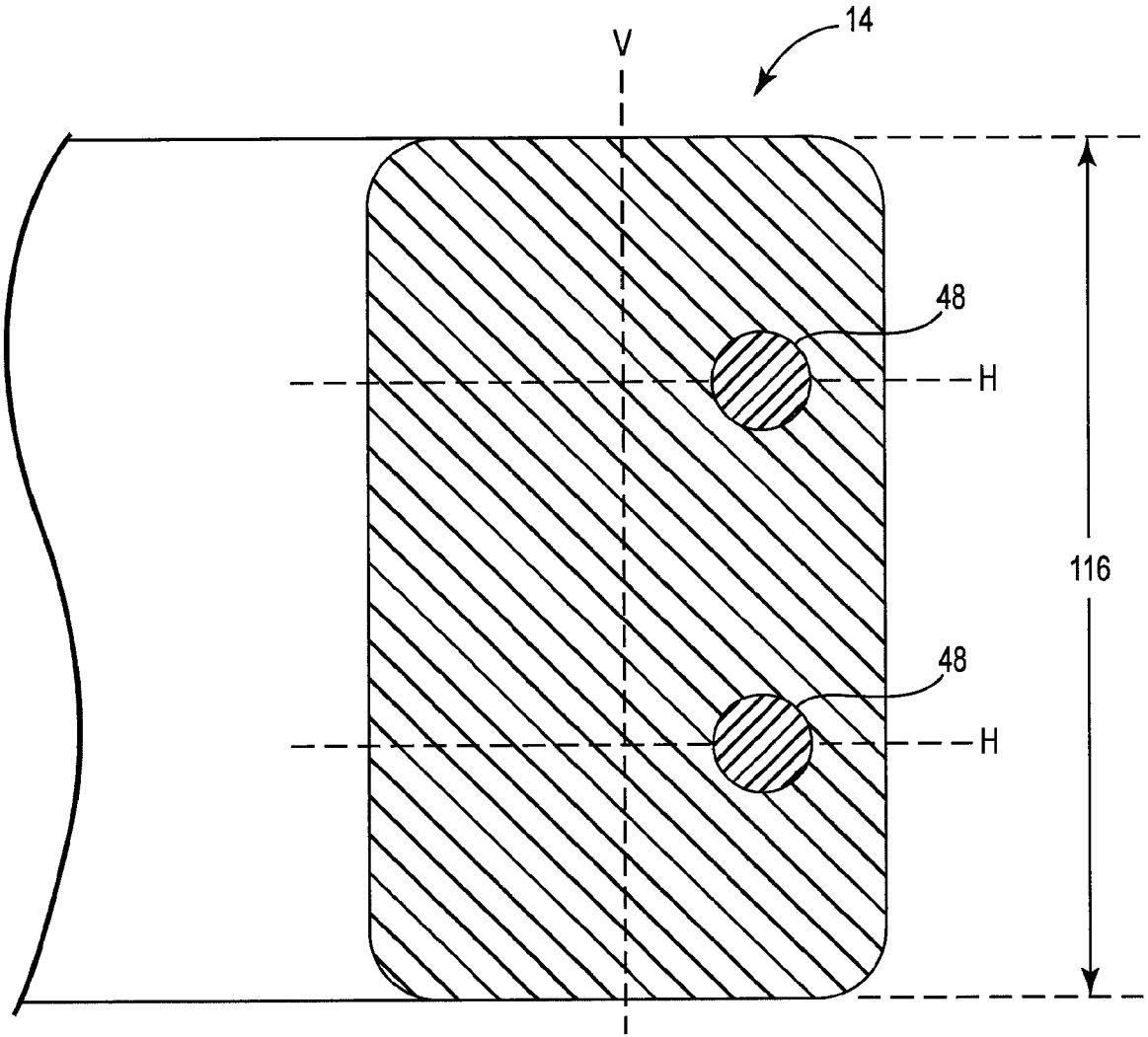
FIG. 8 is a cross-sectional view of another alternative embodiment of a connection mechanism.

FIG. 8 is a cross-sectional view of an alternative connection mechanism 114. Connection mechanism 114 is similar to connection mechanism 14 described above in reference to FIGS. 2-7, however, has a vertical height 116 that is greater than that previously discussed. In one embodiment, the vertical height 116 is about twice the corresponding vertical height of connection mechanism 14, or about 12 inches. In addition to having a greater vertical height, connection mechanism 114 also includes a second internal strengthening member 48 to provide additional strength advantages when subject to horizontal pulling forces. Those skilled in the art will appreciate that the number and location of block connectors within connection mechanism 114 may vary from the embodiment shown in FIG. 8 without departing from the intended scope of the present invention.

Figure 9:
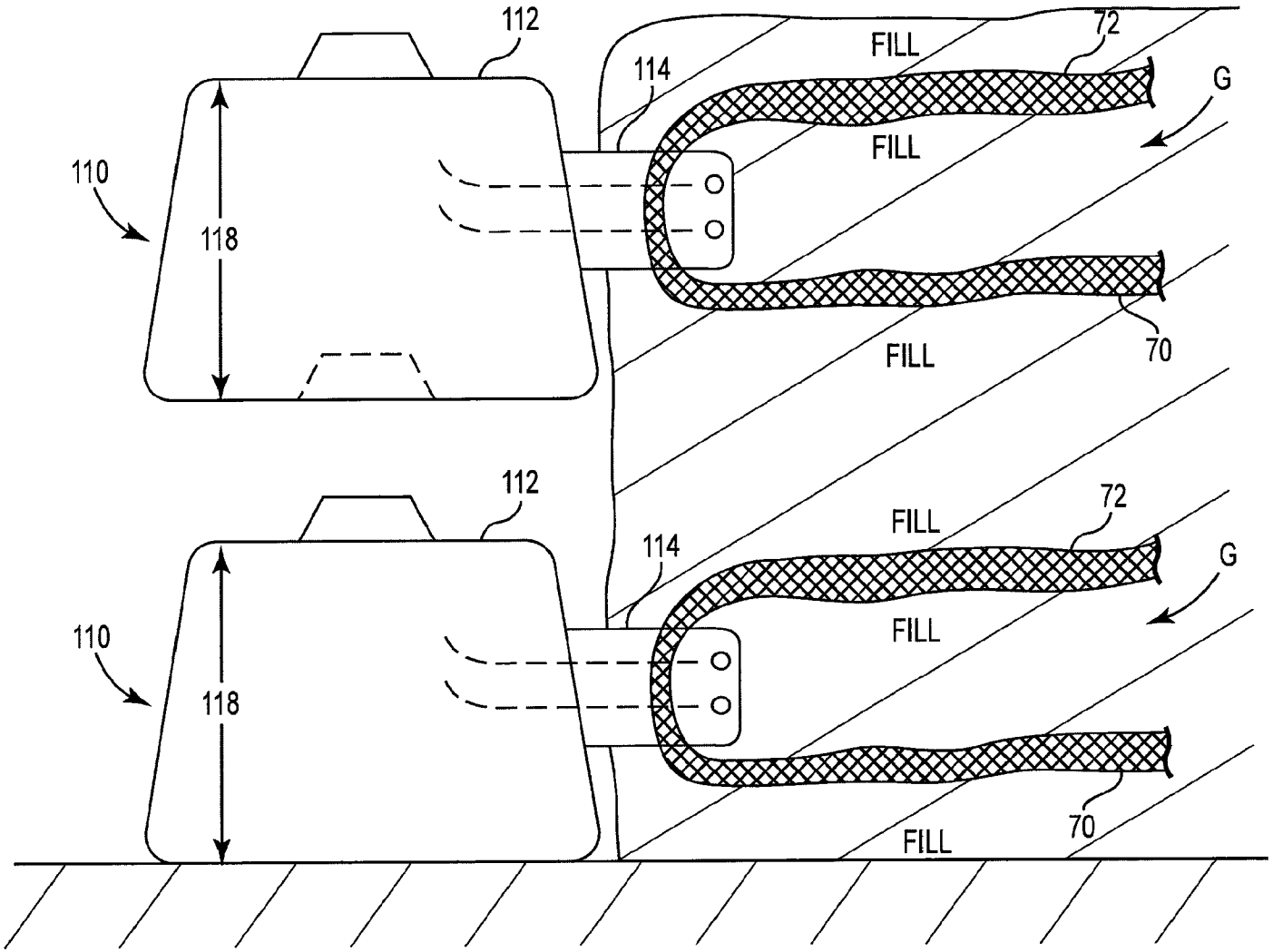
FIG. 9 is a side view of a pair of retaining wall block assemblies having the connection mechanism of FIG. 8 attached thereto.

FIG. 9 is a side view of a pair of retaining wall block assemblies 110 in accordance with the present invention being stacked in order to create a retaining wall. Each of the retaining wall block assemblies 110 includes connection mechanism 114 coupled to a retaining wall block 112. Retaining wall block 112 may be similar in size to retaining wall block 12 previously described in reference to FIGS. 2-7. Alternatively, retaining wall block 112 may have a vertical height 118 that is greater than the corresponding vertical height of retaining wall block 12 in order to better accommodate the larger connection mechanism 114.

As shown in FIG. 9, a grid structure G may be wrapped around connection mechanism 114 in the manner previously described. When assembling a retaining wall with retaining wall blocks 112, the 12-inch vertical height of connection mechanism 114 allows a 12-inch layer of fill to be inserted between the layers of the grid structure G, such as first and second layers 70 and 72. This may be important because, for example, the building code may require layers of fill material that are 12 inches in height instead of 6 inches.

Figure 10:
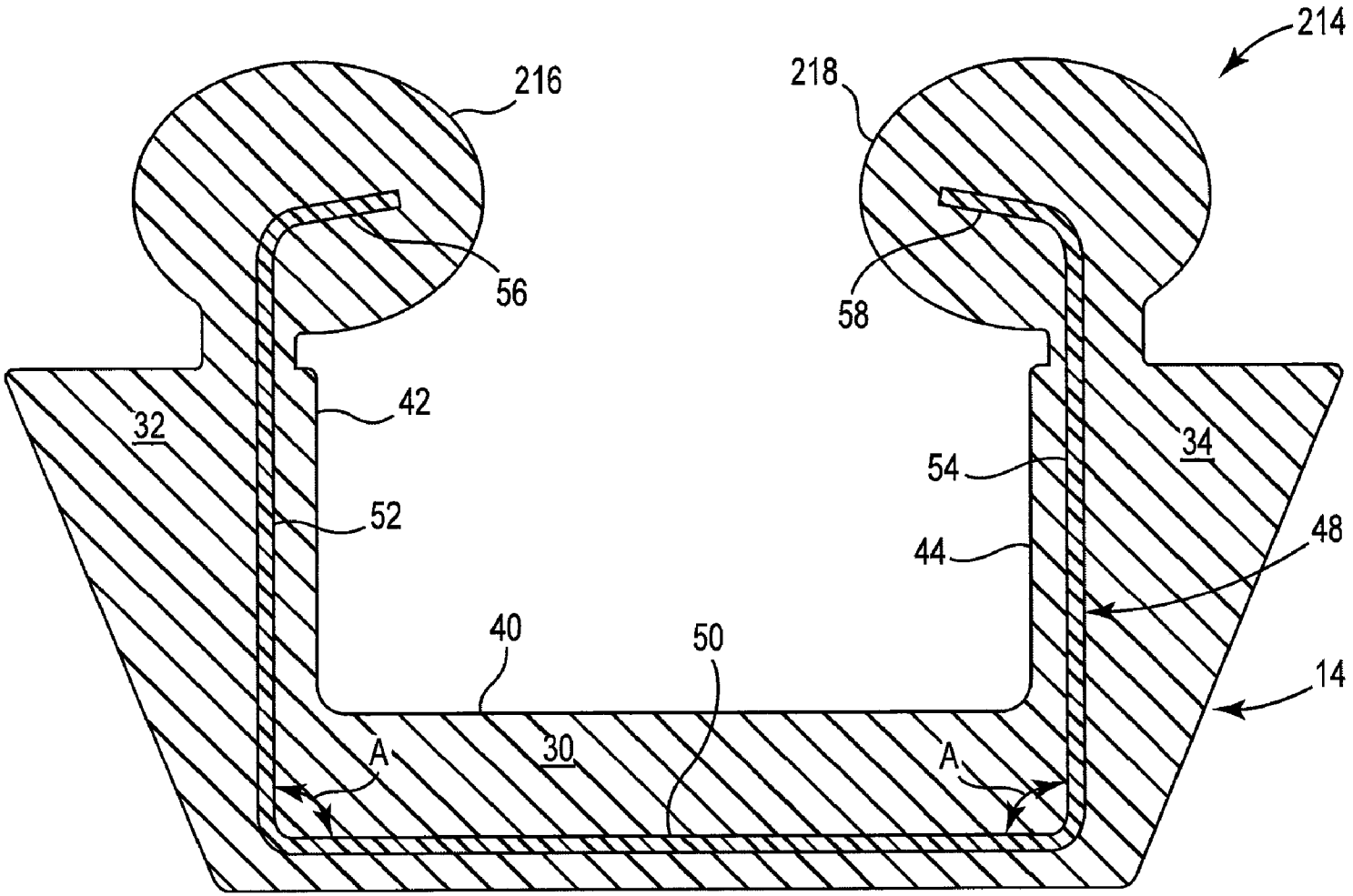
FIG. 10 is a cross-sectional view of a further alternative embodiment of a connection mechanism having a block connector that is completely encased within concrete.

FIG. 10 is a cross-sectional view of connection mechanism 214, which is another alternative embodiment of a connection mechanism in accordance with the present invention. Connection mechanism 214 further includes first and second flange encasement members 216 and 218 encasing first and second flange members 56 and 58, respectively. First and second flange encasement members 216 and 218 may be integral with and extend from first and second arms 52 and 54 of connection mechanism 214.

In the illustrated embodiment, first and second flange encasement members 216 and 218 may be formed from a concrete material that is the same or similar to the concrete material used to form main body 30 and first and second arms 32 and 34 of connection mechanism 214. Thus, connection mechanism 214 may be preferred over connection mechanism 14 when it is desirable to have a concrete-to-concrete connection between the connection mechanism and the retaining wall block to which it will be affixed.

Figure 11:
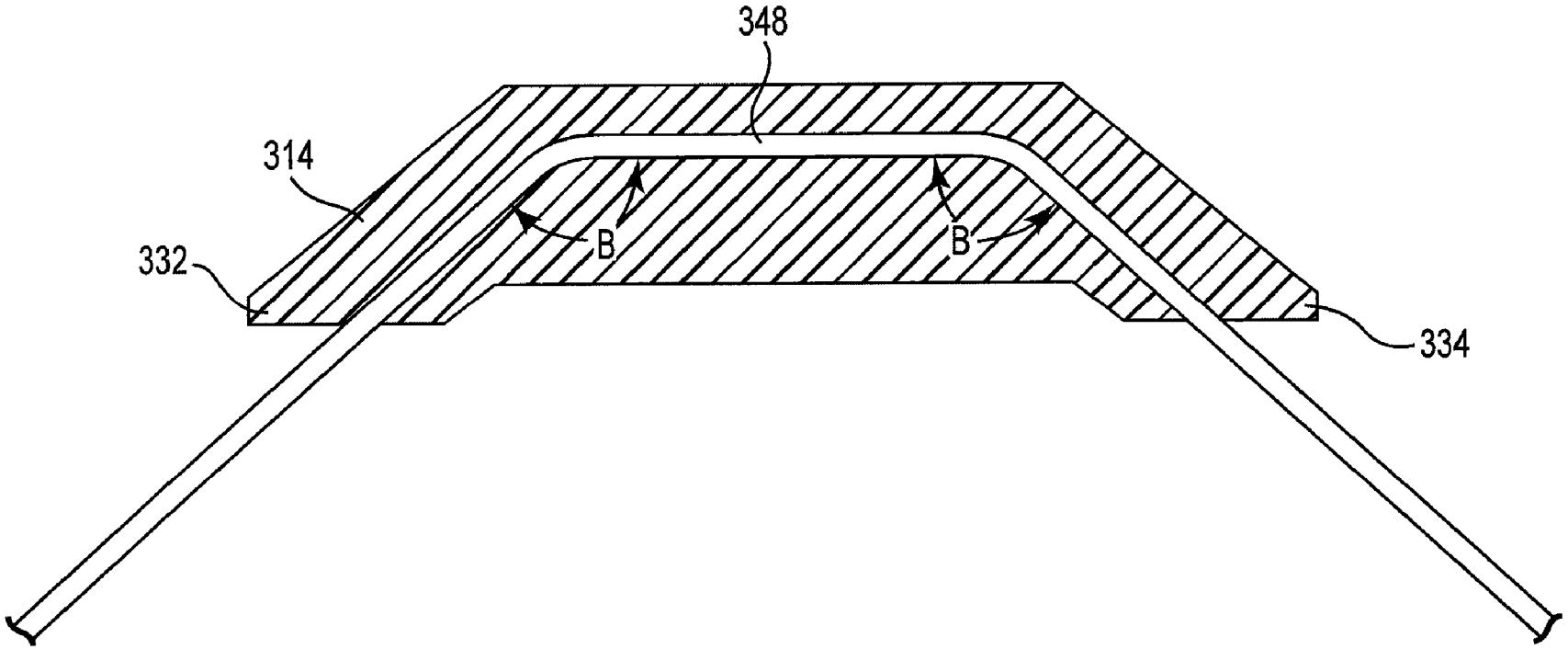
FIG. 11 is a cross-sectional view of yet another alternative embodiment with the reinforcing member and legs configured at angles.

Referring now to FIG. 11, yet another alternative embodiment is illustrated. More specifically, FIG. 11 illustrates a more angled connection mechanism 314 which is specifically configured to more evenly distribute stress. In this particular embodiment, connection member 314 has a first leg 332 and a second leg 334, both of which are arranged in an angled orientation. Additionally, a slightly reconfigured reinforcing member 348 is utilized. As can be seen, reinforcing member 348 includes two angles or bends B at the corners. When compared with reinforcing member 48 of FIG. 4 above, it will be clear that these angles are greatly reduced, thus more evenly distributing pulling forces.

Figure 12:
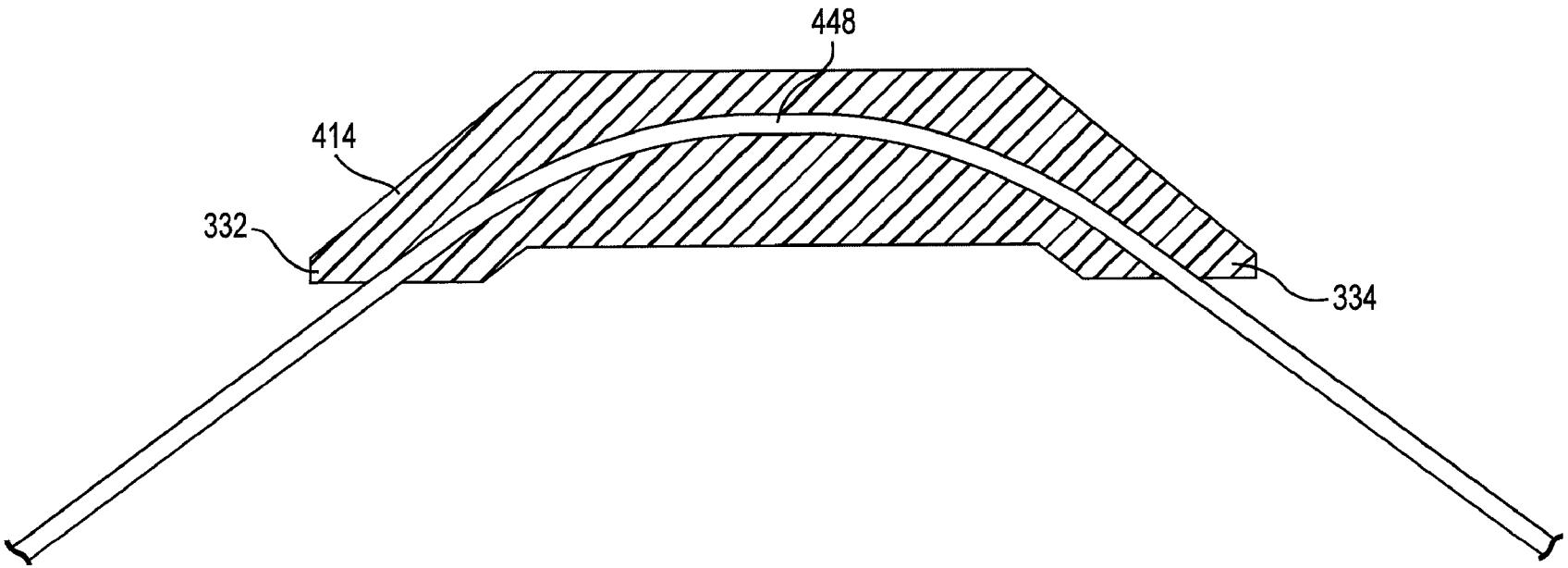
FIG. 12 is a cross-sectional view of an additional embodiment having a curved reinforcing member.

In a similar manner, yet an additional alternative embodiment for a connection mechanism 414 is illustrated at FIG. 12. In this particular embodiment, a revised reinforcement member 448 is utilized which is continuously curved. This particular configuration allows for the use of alternative materials, such as a carbon fiber material or fiberglass reinforced plastic. Naturally, using these alternative materials for reinforcing mechanism 448 provides alternative weight/strength combinations, as desired. As illustrated in this FIG. 12, the body of connection mechanism 414 is otherwise substantially similarly configured as connection mechanism 314 illustrated in FIG. 11 above.

Figure 13:
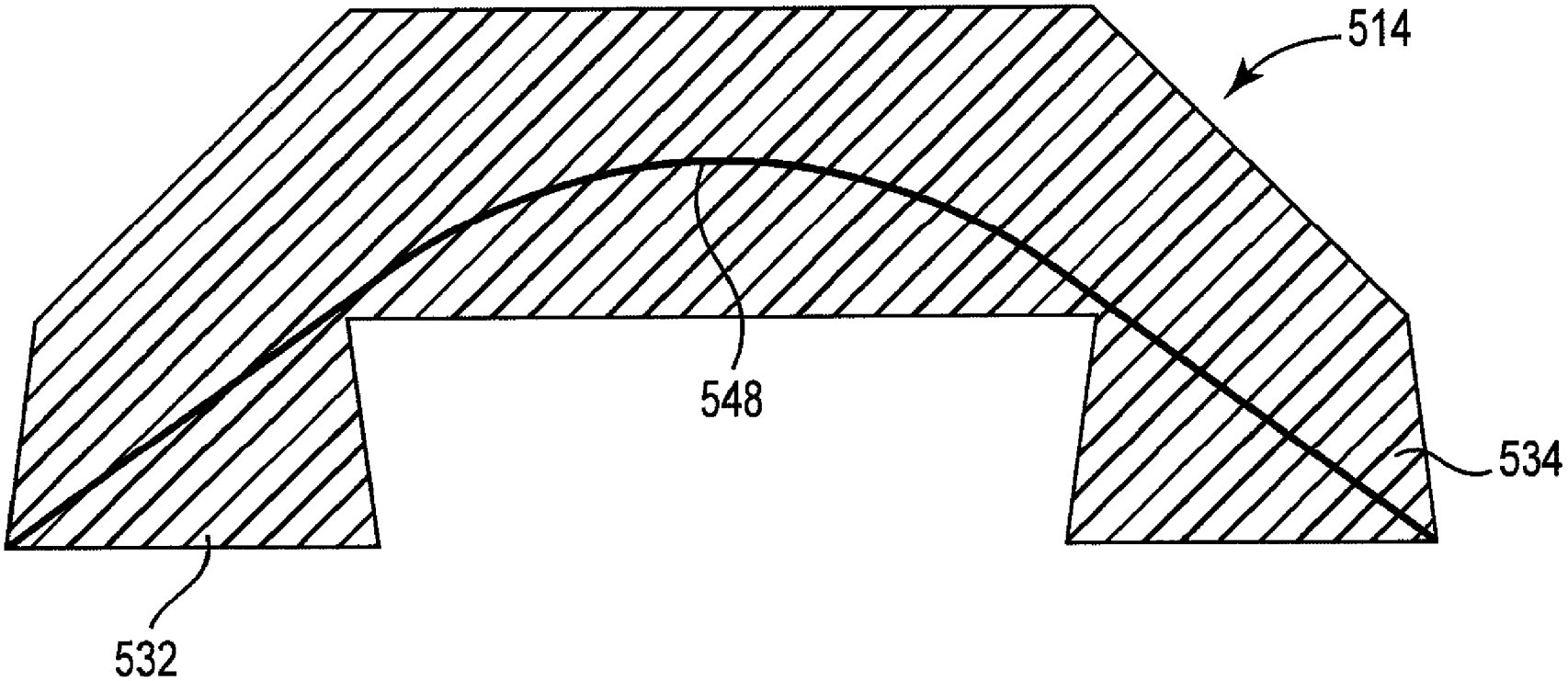
FIG. 13 is a cross-sectional view of another alternative embodiment, using a curved reinforcing member which is completely encased in concrete.

Lastly, referring to FIG. 13, yet a further alternative embodiment is illustrated. In this case, a connection mechanism 514 is shown again utilizing a continuously curved reinforcing member 548. In this embodiment, however, reinforcing member 548 is completely encased in concrete. Connection mechanism 514 does include a first leg 532 and a second leg 534, both of which encase the ends of reinforcement mechanism 548. As also illustrated, first leg 532 and second leg 534 of connection mechanism 514 are angled outwardly from top to bottom (as oriented in FIG. 13). This angled structure allows connection mechanism 514 to be immersed in concrete when utilized to form a retaining wall block. Due to the angles or flares of first leg 532 and second leg 534, a mechanical connection can be formed thereby providing secure attachment. This type of immersed attachment methodology is very similar to that discussed above in relation to FIG. 10.

Although the present invention has been described with reference to preferred embodiments, workers skilled in the art will recognize that changes may be made in form and detail without departing from the spirit and scope of the invention.

We claim:

1. A method for creating a retaining wall block assembly, comprising:

casting a connection member in a predetermined shape by first configuring a strengthening member in a predetermined shape and subsequently casting concrete around the strengthening member, wherein the resulting connection member has an engaging structure at one end thereof;

allowing the connection member to harden to allow handling of the connection member without damaging the structure thereof;

forming a block portion of the retaining wall assembly by filling a block form with a desired amount of concrete, thereby filling the form to a desired level;

positioning and holding the prefabricated connection member in an appropriate orientation wherein the engaging structure is submerged in the concrete of the block portion and a further portion of the connection member extends away from the block portion; and allowing the block portion to cure thus causing the connection member to be coupled to the block portion.

2. The method of claim 1 wherein the connection member is formed in a substantially u-shaped configuration.

3. The method of claim 2 wherein the substantially u-shaped configuration of the connection member includes a u-shaped concrete portion having an end portion of the strengthening member extending from the concrete portion.

4. The method of claim 3 wherein the end portions of the strengthening members form an engaging structure by being bent at a predetermined angle thus creating a physical interference with the cured concrete when formed.

5. The method of claim 2 wherein the connection member has an outer surface which is concrete and includes an engaging structure formed at end portions of the u-shaped configuration which are specifically configured to create a physical interference when the concrete of the block portion is formed around the engaging structure.

6. The method of claim 5 wherein the connection member is formed by first forming the strengthening member and casting the concrete portion of the casting member to completely encase the strengthening member.

7. The method of claim 2 wherein the u-shaped member forms a handle portion on an outer surface of the block portion.

8. The method of claim 2 wherein the connection member is formed to have a substantially smooth outer surface.

9. The method of claim 2 wherein the connection member is formed by further forming a second strengthening member and casting the connection member around the strengthening member and the second strengthening member.

10. A block assembly for use in the formation of retaining walls, comprising:

a substantially solid block portion having a front surface and a rear surface opposite the front surface; and a connection member extending from the rear surface of the block portion, the connection member including an internal strengthening member and an outer concrete portion forming a relatively smooth outer surface, wherein the internal strengthening member further extends into the solid block portion beyond rear surface thus forming a physical connection; and wherein the connection member and the rear surface form an unobstructed connection slot capable of accommodating the attachment of other components to the block assembly.

11. The block assembly of claim 10 wherein the portion of the strengthening member extending into the substantially solid block portion below the rear surface is non-linear.

12. The block assembly of claim 11 wherein the connection member further comprises a second parallel strengthening member situated substantially parallel to the strengthening member and also having a non-linear portion.

13. The block assembly of claim 11 wherein the strengthening member is formed of steel reinforcing bar stock.

14. The block assembly of claim 11 wherein the strengthening member is formed of composite materials.

15. The block assembly of claim 11 wherein the substantially solid block portion is formed of concrete, and a connection formed between the substantially solid block portion and the strengthening member is made possible by inserting the strengthening member into the substantially solid block portion as the concrete is cured.

16. The block assembly of claim 10 wherein the connection member is prefabricated prior to the formation of the block assembly, and wherein the connection member is substantially unshaped having a main base portion and two leg portions extending from the base portion, wherein a connection slot is formed between the base portion, the two leg portions and the rear surface of the solid block portion.

17. The block assembly of claim 10 wherein the wherein the internal strengthening member is encased in concrete with the encasement formed from an irregular shape and wherein the irregular shape is further extends into the solid block portion beyond rear surface and is thus encased in the concrete of the main block portion thereby forming a physical connection between the main block portion and the connection member.

* * * * *